US006996243B2

(12) United States Patent
Welker et al.

(10) Patent No.: US 6,996,243 B2
(45) Date of Patent: Feb. 7, 2006

(54) LOUDSPEAKER WITH SHAPED SOUND FIELD

(75) Inventors: Andrew C. Welker, Courtice (CA); John Tchilinguirian, Bowmanville (CA)

(73) Assignee: Audio Products International Corp., Scarborough (CA)

( * ) Notice: Subject to any disclaimer, the term of this patent is extended or adjusted under 35 U.S.C. 154(b) by 339 days.

(21) Appl. No.: 10/378,087

(22) Filed: Mar. 4, 2003

(65) Prior Publication Data

US 2003/0179899 A1 Sep. 25, 2003

Related U.S. Application Data

(60) Provisional application No. 60/361,355, filed on Mar. 5, 2002.

(51) Int. Cl.
*H04R 25/00* (2006.01)

(52) U.S. Cl. ..... 381/160; 381/182; 381/386; 381/186; 381/342; 381/350

(58) Field of Classification Search ..... 381/150, 381/160, 182, 186, 342, 350, 385, 386, 162, 381/337; 181/155, 156, 144, 145, 147, 199
See application file for complete search history.

(56) References Cited

U.S. PATENT DOCUMENTS

| | | | | |
|---|---|---|---|---|
| 2,440,078 | A | | 4/1948 | Devine |
| 2,820,525 | A | | 1/1958 | Fountain et al. |
| 3,326,321 | A | | 6/1967 | Valuch |
| 3,371,742 | A | | 3/1968 | Norton et al. |
| 3,424,873 | A | | 1/1969 | Walsh |
| 3,500,953 | A | | 3/1970 | Lahti |
| 3,540,544 | A | | 11/1970 | Karlson |
| 3,765,504 | A | | 10/1973 | Itoh |
| 3,816,672 | A | | 6/1974 | Gefvert et al. |
| 3,964,571 | A | * | 6/1976 | Snell ..... 181/150 |
| 4,122,911 | A | | 10/1978 | Croup |
| 4,200,170 | A | | 4/1980 | Williams, Jr. |
| 4,225,010 | A | | 9/1980 | Smith |
| 4,251,687 | A | | 2/1981 | Deutsch |
| 4,256,922 | A | | 3/1981 | Görike |
| 4,348,549 | A | | 9/1982 | Berlant |
| 4,410,063 | A | | 10/1983 | Yasue et al. |
| 4,475,620 | A | | 10/1984 | Carlsson |
| 4,574,906 | A | | 3/1986 | White et al. |
| 4,701,951 | A | | 10/1987 | Kash |
| 4,882,760 | A | | 11/1989 | Yee |
| 4,907,671 | A | | 3/1990 | Wiley |
| 4,984,653 | A | | 1/1991 | Spors |

(Continued)

FOREIGN PATENT DOCUMENTS

| | | |
|---|---|---|
| CA | 2358085 | 3/2003 |

(Continued)

*Primary Examiner*—Huyen Le
*Assistant Examiner*—Tuan Duc Nguyen

(57) ABSTRACT

The loudspeaker and method provide a driver of a loudspeaker that is movable parallel to an axis of movement through a center of the driver to produce sound waves. The driver is aligned with the driver plane orthogonal to the axis of movement. The driver plane is at a non-zero acute angle to a support plane. A reflector is mounted facing a diaphragm of the driver for reflecting sound waves from the driver. The reflector is configured relative to the driver such that reflected sound energy is greatest in a selected direction from a front of the reflector and the driver, and diminishes a progressively larger angle from the selected direction. The selected direction diverges from the driver plane.

23 Claims, 11 Drawing Sheets

U.S. PATENT DOCUMENTS

| | | | |
|---|---|---|---|
| 5,031,220 | A | 7/1991 | Takagi et al. |
| 5,115,882 | A | 5/1992 | Woody |
| 5,131,052 | A | 7/1992 | Hill et al. |
| 5,193,119 | A | 3/1993 | Tontini et al. |
| 5,220,608 | A | 6/1993 | Pfister |
| 5,258,584 | A | 11/1993 | Hubbard |
| 5,446,792 | A | 8/1995 | Sango |
| 5,471,018 | A | 11/1995 | Nieuwendijk et al. |
| 5,485,521 | A | 1/1996 | Yagisawa et al. |
| 5,525,767 | A | 6/1996 | Fields |
| 5,943,431 | A | 8/1999 | Weiss et al. |
| 5,988,314 | A | 11/1999 | Negishi |
| 5,995,634 | A | 11/1999 | Zwolski |
| 6,009,972 | A | 1/2000 | Choi et al. |
| 6,031,920 | A | 2/2000 | Wiener |
| 6,118,883 | A | 9/2000 | Rocha |
| 6,603,862 | B1 | 8/2003 | Betts |
| 6,625,289 | B1 | 9/2003 | Oliemuller |

FOREIGN PATENT DOCUMENTS

| | | |
|---|---|---|
| EP | 0 606 764 | 7/1994 |
| WO | WO 00/67522 | 11/2000 |

* cited by examiner

LOUDSPEAKER WITH SHAPED SOUND FIELD

This application claims benefit of 60/361,355 Mar. 5, 2002.

FIELD OF THE INVENTION

This invention relates to audio loudspeakers.

BACKGROUND OF THE INVENTION

Omni-directional loudspeakers, which transmit sound in all directions are well-known. Typically, such loudspeakers have an axis along which at least one driver is mounted such that the driver's cone moves in an axial direction. Typically the axial direction is normal to the floor or ground of the area in which the loudspeaker is used. The driver generates sound waves which propagate either upwards away from or downwards towards the floor or ground. A sound reflector is positioned co-axially with the driver to reflect the sound waves to produce reflected waves which propagate away from the loudspeaker with equal strength in all directions. Such omni-directional speakers desirably provide a wide sound field which allows a person positioned in any direction around the loudspeaker to hear wide bandwidth sound produced by the loudspeaker.

Modern sound systems, including so-called home theatre systems, often incorporate 5 or more loudspeakers which are positioned at various locations within a listening room. The loudspeakers are preferably configured and positioned to provide a balanced sound field in a listening area. To increase the size of the listening area in which a relatively flat frequency response is achieved, it is desirable to use loudspeakers with a relatively wide sound field. To enhance the balance of the sound field at the listening position, it is desirable to control the shape of the sound field produced by any particular loudspeaker. To achieve a wide sound field from a loudspeaker, it is desirable to attain a wide dispersion pattern across a wide portion of the audible frequency range.

Accordingly, it is desirable to provide a loudspeaker that allows the wide sound field characteristics of an omni-directional loudspeaker to be shaped.

SUMMARY OF THE INVENTION

An object of an aspect of the present invention is to provide an improved loudspeaker.

In accordance with this aspect of the present invention there is provided a loudspeaker comprising: (a) a base defining a support plane, the base being operable to support the loudspeaker relative to surface; (b) a driver mounted to the base, the driver being movable parallel to a direction of movement to produce sound waves; and, (c) a reflecting surface mounted a diaphragm of the driver for reflecting sound waves from the driver. The reflecting surface is configured relative to the driver such that the reflected sound energy is greatest in a selected direction from a front of the reflecting surface and the driver, and diminishes at progressively larger angles from the seleted direction. The driver is aligned with a driver plane orthogonal to the axis of movement, the driver plane being at a non-zero acute angle to the external support plane. The selected direction diverges from the driver plane.

An object of a second aspect of the present invention is to provide an improved loudspeaker.

In accordance with this second aspect of the present invention there is provided a loudspeaker comprising: (a) a base defining a support plane, the base being operable support the loudspeaker relative to surface; (b) an input terminal for receiving an audio signal and a cross-over connected to the input terminal for dividing the audio signal into a plurality of component signals; (c) a first driver mounted to the base and linked to the cross-over to receive a first component signal in the plurality of signals, the first driver being drivable by the first component signal to move parallel to a first axis of movement through a center of the first-driver to produce sound waves; (d) a first reflector mounted facing a first diaphragm of the first driver for reflecting sound waves from the first driver, the first reflector being configured relative to the first driver such that reflected sound energy is greatest in a first selected direction from a front of the first reflector and the first driver, and diminishes at progressively larger angles from the first selected direction; and, (e) at least one of a second driver for producing higher frequency sound waves than the sound waves produced by the first driver and a third driver for producing lower frequency sound waves than the sound waves produced by the first driver, the at least one of the second driver and the third driver being mounted to the base and linked to the cross-over to receive at least one component signal in the plurality of component signals from the crossover. The first driver is aligned with a first driver plane orthogonal to the axis of movement, the first driver plane being at a non-zero acute angle to the support plane. The first selected direction diverges from the first driver plane.

An object of a third aspect of the present invention is to provide an improved loudspeaker.

In accordance with this third aspect of the present invention there is provided a method of directing sound waves from a driver of a loudspeaker. The method comprises: (a) providing an audio signal to the driver, the driver being movable parallel to an axis of movement through a center of the driver to produce sound waves based on the audio signal; (b) orienting the driver such that a driver plane orthogonal to the axis of movement is at a selected angle of inclination relative to a horizontal plane, the selected angle of inclination being a non-zero acute angle; and, (c) reflecting sound waves from the driver such that reflected sound energy is greatest in a selected direction from a front of the driver and diminishes at progressively larger angles from the selected direction. The selected direction diverges from the driver plane.

BRIEF DESCRIPTION OF THE DRAWINGS

A preferred embodiment of the present invention will now be described in detail with reference to the drawings, in which.

DETAILED DESCRIPTION OF THE INVENTION

Human hearing is at its most sensitive to sound within a fairly narrow region between 2 kHz and 5 kHz. This is also the region where our brains perform much of the processing needed to localize or determine the position or origin of sound.

In audio systems, multiple loudspeakers are used to recreate a three-dimensional recorded event. That is, a three-dimensional effect is created through the position, intensity and time delay between the two or more channels. Our brains are able to recreate a sense of space and size because of this, as well as a sense of the reflections that occur within a typical room. For example, listening to a symphony orchestra in a very good concert hall, one hears sound that has a very high proportion of reflected information. Typically, 70% of the audio information will be reflected, and only 30% will be direct sound from the performance on stage.

If we listen to a typical speaker with drivers on the vertical plane, much of the sound, particularly at high frequencies, will be directed right at the listener and the reflected content will be minimal. This lack of reflected information, compared to what happens in reality, would reduce the perceived size of the sound—the "soundstage". However, because of the large amount of direct signal between 2 kHz to 5 kHz, a speaker with drivers on the vertical plane will produce tightly defined acoustic images. In the other extreme, in a prior art omni directional speaker with a reflector above a driver on the horizontal plane, the ratio of reflected information to direct information from the speaker will be very high. As a result, a large sense of space, such as in a concert hall, will be created in the brain. However, as very little direct signal reaches the listener, particularly in the 2 kHz to 5 kHz region, poorly defined images that do not mimic reality will be created in the brain.

Embodiments of the present invention permit the ratio of direct signal to reflected signal to be varied, particularly at frequencies between 2 kHz to 5 kHz, which is the upper operating range of a woofer. By doing so, the reflected information required to produce a large soundstage can be retained. At the same time, by also retaining a sufficient amount of direct signal, the image created by the sound can be focused to better duplicate the sound of a live performance.

Figure 1:
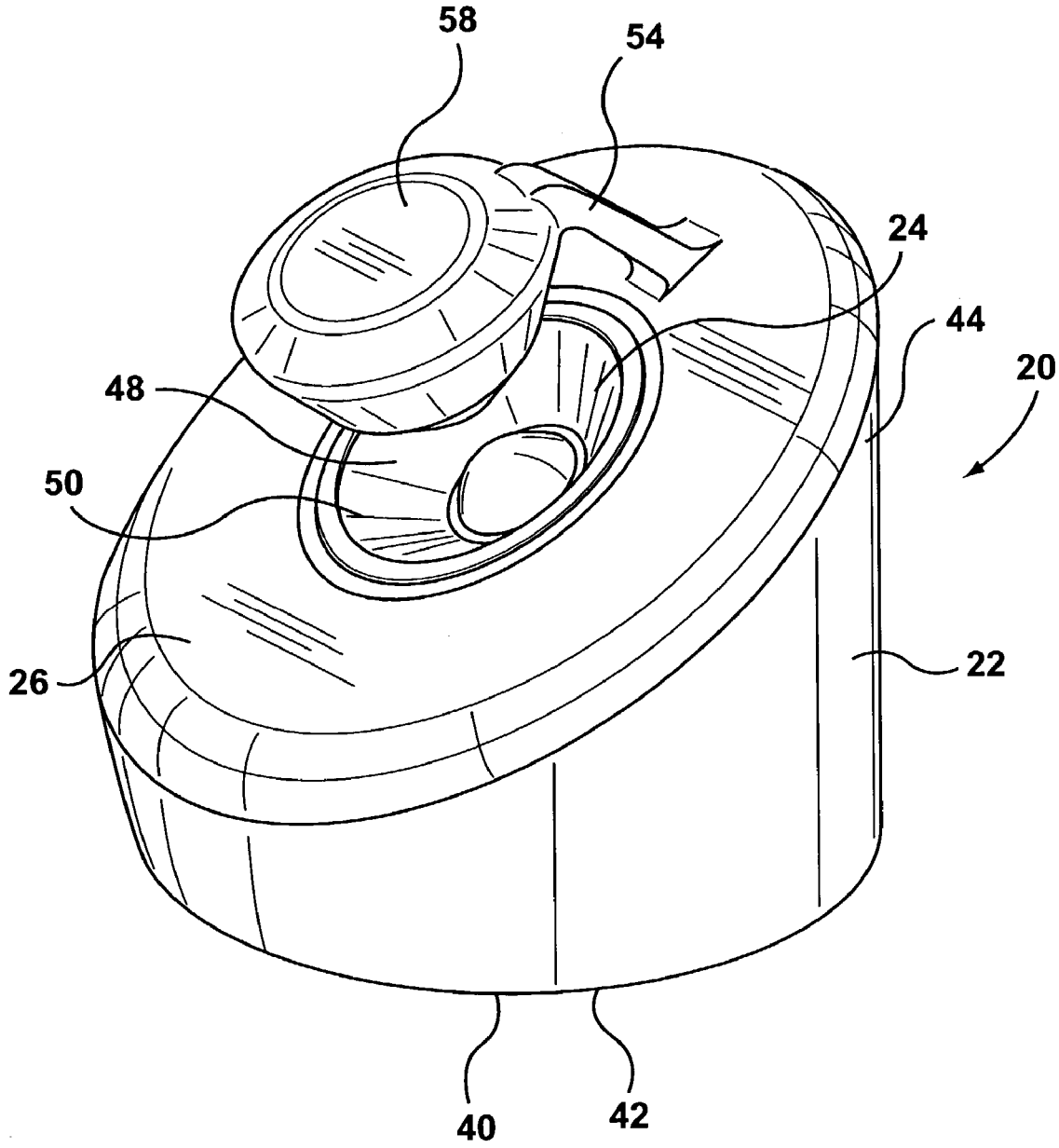
FIG. 1 is a perspective drawing of a loudspeaker according to a first embodiment of the present invention.

Reference is first made to FIG. 1, which illustrates a loudspeaker 20 according to a first embodiment of the present invention. Loudspeaker 20 has a housing 22, a driver 24, a housing baffle 26, input terminals 28, 30 (FIG. 2) and a sound reflector 32.

Figure 2:
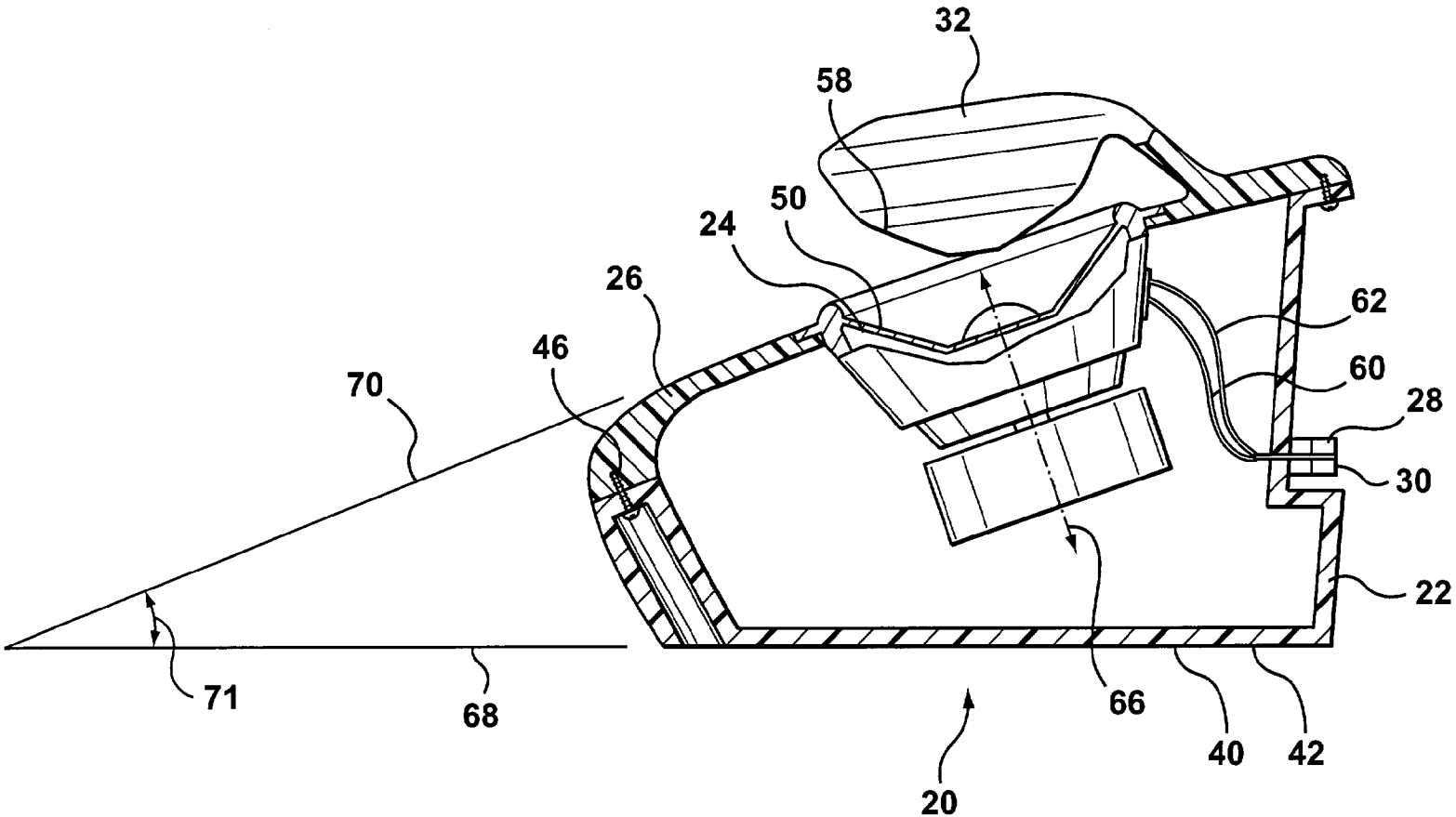
FIG. 2 is a cross-sectional side view of the loudspeaker of FIG. 1.

Housing 22 has a base 40, which also defines the base 42 of loudspeaker 20. Baffle 26 is mounted on the top 44 of housing 22 using several screws 46 (FIG. 2). Alternatively, baffle 26 may be mounted to housing 22 using a friction mount, another type of fastener or any other method. Driver 24 is mounted in an opening 48 in baffle 26. Driver 24 is mounted such that its cone 50 faces out from the top of baffle 26. Sound reflector 32 is formed integrally with baffle 26 and is spaced apart from baffle 26 by support 54, which is also formed integrally with baffle 26. In another embodiment of the present invention, sound reflector 32 and support 54 may be formed separately from baffle 26 and may be assembled with baffle 26 using one or more fasteners and/or an adhesive.

Sound reflector 32 is positioned above driver 24 and has a sound reflecting surface 58 which faces the cone 50 of driver 24.

Terminals 28, 30 are mounted on a rear side of housing 22. Terminals 28, 30 may be any type of mounting terminals suitable for attaching audio cables (not shown). Terminals 28, 30 are coupled to driver 24 by wires 60, 62 (FIG. 2).

Referring next to FIG. 2, the base 42 of loudspeaker 20 generally defines a base plane 68, which in operation rests on external support plane, provided by, for example, a floor or a bookshelf. The top edge of cone 50 defines a driver plane 70. Driver plane 70 is at an angle 71 to base plane 68.

In use, loudspeaker 20 may be positioned so that base plane 68 is substantially parallel to the floor or ground (not shown) in the area where loudspeaker 20 is used. As a result, driver plane 70 will typically not be parallel to the floor or ground. Alternatively, loudspeaker 20 may be suspended from a ceiling so that its base is parallel to the floor or ground, or it may be mounted with its base or back against a wall.

In use, loudspeaker 20 receives an audio signal at terminals 28, 30 from a signal source (not shown) in known manner. The signal source may be an audio receiver or amplifier. A skilled person will understand the operation and connection of an appropriate audio source and this is not further described here.

Figure 3:
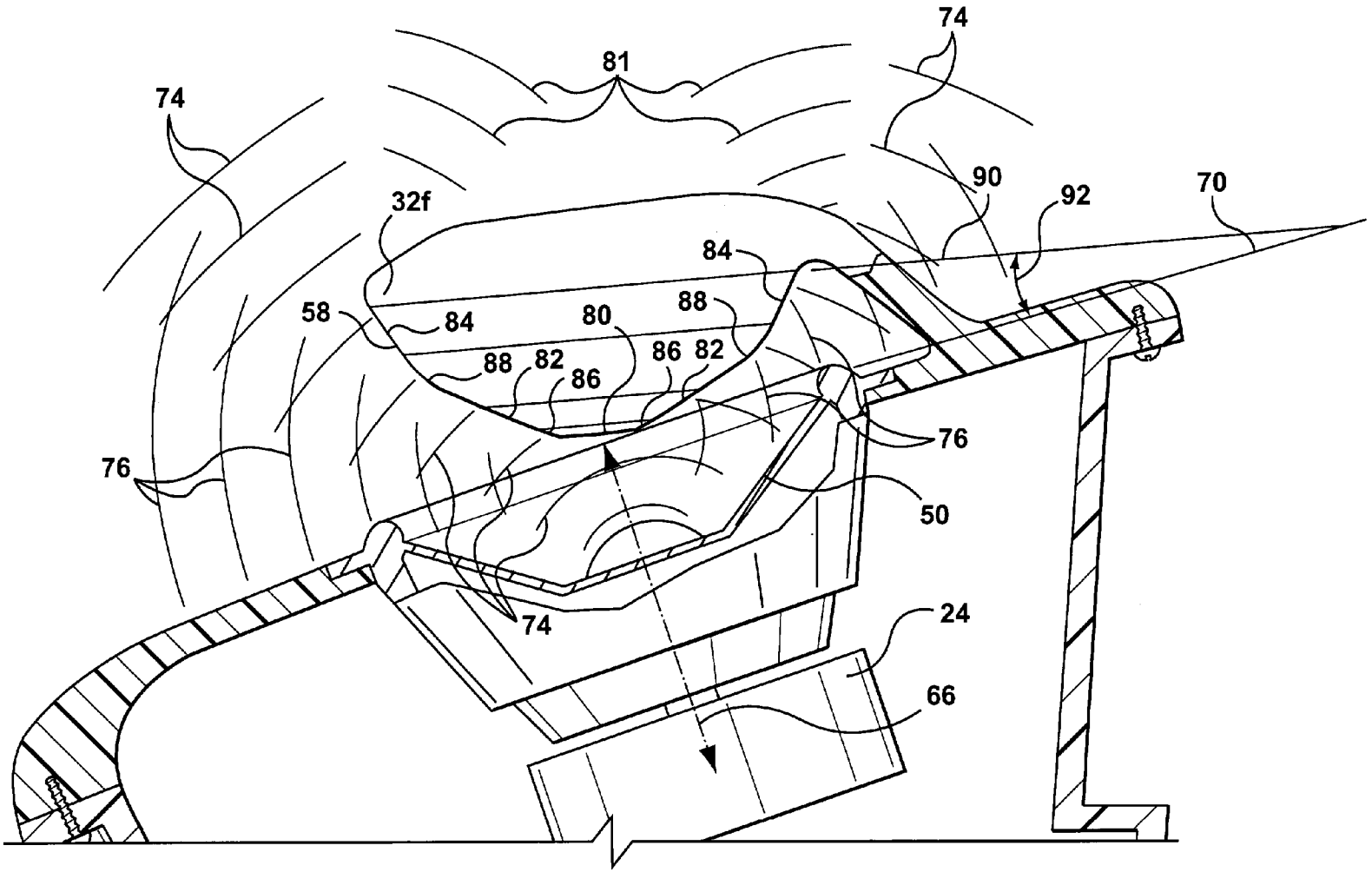
FIG. 3 is a detailed cross-sectional view of a sound reflector and a driver of the loudspeaker of FIG. 1.

Reference is next made to FIG. 3, which is an enlarged view of driver 24 and sound reflector 32. Driver 24 receives the audio signal through wires 60, 62 (FIG. 2) and causes its cone 50 to move in an axial direction 66, which will typically be normal to driver plane 70. As cone 50 moves, it creates sound waves 74. Sound waves 74 have a range of frequency components with the specific range depending on the selection of driver 24. Higher frequency components, and particularly those with a wavelength shorter than the diameter of cone 50, are propagated in a direction generally normal to driver plane 70, in the direction of reflecting surface 58. As sound waves 74 strike reflecting surface 58, they are reflected outwardly from loudspeaker 20 as sound waves 76. Although sound waves 76 are shown propagating from loudspeaker towards the front and rear of loudspeaker 20, sound waves 76 will actually propagate away from loudspeaker 20 in all directions.

Figure 4:
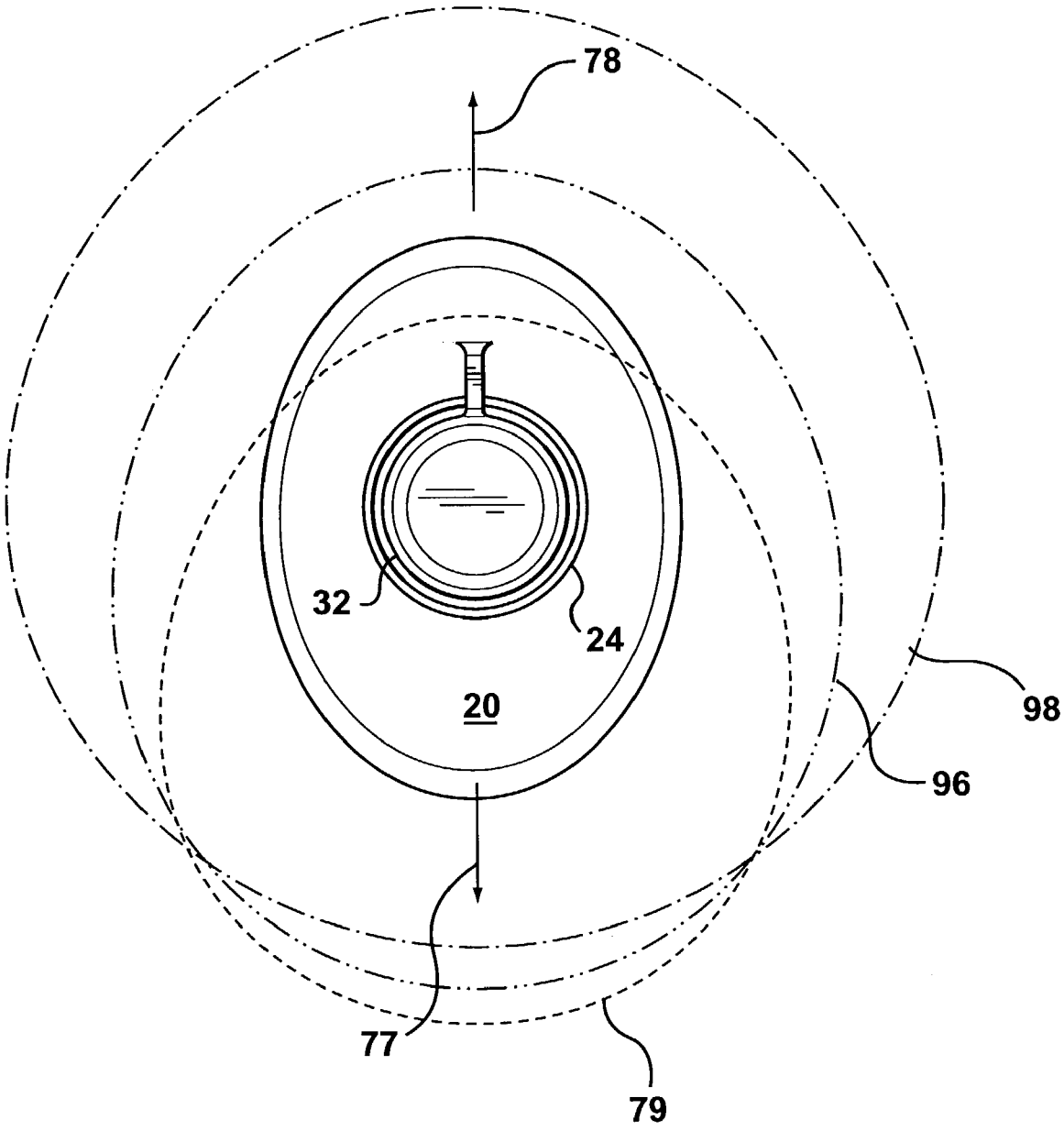
FIG. 4 is a top view of the loudspeaker of FIG. 1.

Reference is additionally made to FIG. 4. Reflector 32 is positioned above driver 24 such that sound waves 74 are reflected as sound waves 76 unequally. Relatively large portions of sound waves 76 are reflected in direction 77 from the front of loudspeaker 20. This means that a relatively large portion of the sound energy produced by driver 24 is directed outward from the loudspeaker 20 in direction 77.

Progressively less of sound waves 76 (and progressively less of the sound energy produced by sound energy produced by loudspeaker 20) are reflected in each direction at progressively larger angles from the front of loudspeaker 20. The smallest portions of sound waves 76 are reflected in direction 78 towards the rear of loudspeaker 20. Curve 79 illustrates the relative strength of the sound waves 76 reflected in all directions away from loudspeaker 20.

Reference is again made to FIG. 3. The relative amplitude of sound waves 76 propagated away from loudspeaker 20 in any direction depends on the shape and size of reflector 32, the position of reflector 32 with respect to driver 24 and the size and shape of driver 24. The reflecting surface 58 of sound reflector 32 has a compound surface with three flat sections 80, 82 and 84 separated by curved sections 86 and 88. Curved section 86 has a smaller radius of curvature than curved section 88.

The particular size and shape of reflecting surface 58 in any particular embodiment of a loudspeaker 20 according to the present invention will depend on the frequency response of the driver 24 and on the frequency response desired for the loudspeaker 20. Driver 24 of this exemplary loudspeaker 20 is a full range loudspeaker chosen to cover a large portion of the audible frequency spectrum. The shape of reflection surface 58 has been found to provide a relatively flat frequency response for loudspeaker 20, when used with such a loudspeaker. If a different frequency response or dispersion pattern is desired for loudspeaker 20, a differently shaped reflection surface may be used. For example, a parabolic, elliptical, hyperbolic or circular reflection surface may be used in alternative embodiments.

A driver 24 of any shape or size may be used with the present invention. If a larger driver 24 is used, a larger proportion of the generated sound waves will be directional. The size of sound reflector 74, 76 may need to be increased, if it is desired that the reflector 32 effectively redirect the large range of directional frequency components.

Reference is made to FIG. 4. The degree to which reflector 32 is effective in reflecting sound waves 74 also depends on the frequency of the sound waves 74. It is well known-that low frequency audio waves are less directional than higher frequency audio waves. This means that a low frequency sound diverges more widely and propagates in virtually all directions (in three dimensions) away from its source (typically a loudspeaker). A high frequency sound on the other hand is less divergent and propagates in a comparatively narrow or focused direction compared to the low frequency sound. In the absence of sound reflector 32, low frequency sounds produced by driver 24 would propagate widely in all directions away from loudspeaker 20. However, high frequency sounds would travel upwards along line 66 (FIG. 3) and would diverge much more narrowly.

High frequency sound waves are more easily reflected by obstacles in their paths, particularly when the obstacle is larger than the wavelength of the sound waves. In contrast, lower frequency sound waves are affected to a lesser degree by obstacles in their path. This means that higher frequency components of sound waves 74 (FIG. 3) will be reflected by sound reflector 32 more than lower frequency components. Sound reflector 32 is sized so that its diameter 90 is larger than the wavelength of frequency components that sound reflector 32 is intended to reflect.

As noted above, driver 24 is selected to generate sound waves 74 with a broad range of frequency components. Curve 79 illustrates the shape of the sound field produced by loudspeaker 20 for relatively high audio frequencies. Curve 96 illustrates the shape of the sound field produced by loudspeaker 20 for mid-range audio frequencies. Curve 98 illustrates the shape of the sound field produced by loudspeaker 20 for relatively low audio frequencies. Curves 79, 96 and 98 are merely illustrative, are not to scale and do not define boundaries of the sound field at each frequency range. They are intended to illustrate the general shape of wave propagation in each frequency range. Curves 79, 96 and 98 illustrate that the total sound field produced by loudspeaker 20 will have more directional higher frequency components and less directional low frequency components. The sound field produced by loudspeaker 20 will radiate away from loudspeaker 20 in three dimensions. The vertical shape of the sound field at frequency range is similar to its horizontal dimension. Thus, curves 79, 96 and 98 illustrate the cross-section of the sound field in each corresponding frequency range.

The shape of reflecting surface 58 has been found to give a relatively flat frequency response for loudspeaker 20 across a wide frequency range, when measured from a horizontal position at about the height of loudspeaker 20. Loudspeaker 20 provides a large three-dimensional listening area at its front side and makes efficient use of the sound energy generated by driver 24 in doing so.

In this exemplary loudspeaker 20, the angle 71 between base plane 68 and driver plane 70 is 25 degrees. In other embodiments of the present invention, this angle is 30 degrees. This angle is chosen to provide a flat driver frequency response along axis 66 (FIG. 3). In other embodiments of the present invention, this angle may be between 5 and 85 degrees, between 10 degrees and 80 degrees, or between 20 and 35 degrees.

A sound reflector plane 90 may be defined for sound reflector 32 across the top of reflecting surface 58. The angle 92 between sound reflector plane 33 and driver plane 70 is chosen based on the sound dispersion pattern that is desired to be produced by loudspeaker 20. The desirable sound dispersion pattern will depend on the application of the loudspeaker 20. For example, depending on the room (or type of room) in which the loudspeaker 20 is expected to be used, different sound reflections will occur at the room's boundaries (i.e. the walls defining the room). Typically, loudspeaker 20 will be placed with its rear close to the wall or the back of a bookshelf. By angling sound reflector 32 so that its front side **32*f* is angled downwards, as in the exemplary loudspeaker 20, the sound waves directed from the front of loudspeaker 20 will be concentrated towards a listener in front of the loudspeaker 20 at generally the same height as the loudspeaker 20. At the same time, the sound waves reflected from the back of the loudspeaker 20 will have a slight upwards direction and will bounce off the wall or bookshelf and be reflected frontwards and upwards at a generally higher height than the sound waves reflected from the front of loudspeaker 20. This contributes to a spacious sound field. Angle 92** affects the vertical response characteristics of a loudspeaker made according to the present invention. A skilled person will be capable of selecting an appropriate angle to provide a desired sound filed characteristic.

Sound reflector 32 operates to shape both the horizontal and vertical shape of the sound field produced by loudspeaker 20. The shape and the angle of sound reflector 32 relative to driver plane 70 have been described above. As sound waves 74 produced by driver 24 encounter sound reflector 32, some of them will actually wrap around sound reflector 32 and form diffracted sound waves 81 (FIGS. 2 and 3) above sound reflector 32. Higher frequency components of sound waves 74 that have a wavelength smaller than the diameter of sound reflector 32 will be both diffracted and reflected by sound reflector 32 as sound waves 81 and as sound waves 76. The proportion of the sound waves 74 that will be diffracted increases as the size of the sound reflector 32 is reduced. Sound reflector 32 may be sized to provide a desired sound field may be produced in both the horizontal and vertical directions in the listening area.

As noted above, loudspeaker 20 is provided with a driver 24 selected to produce sound with a wide frequency range in response to an audio signal. It may be desirable to generate different audio frequency ranges (which may overlap) with different drivers.

Figure 5:
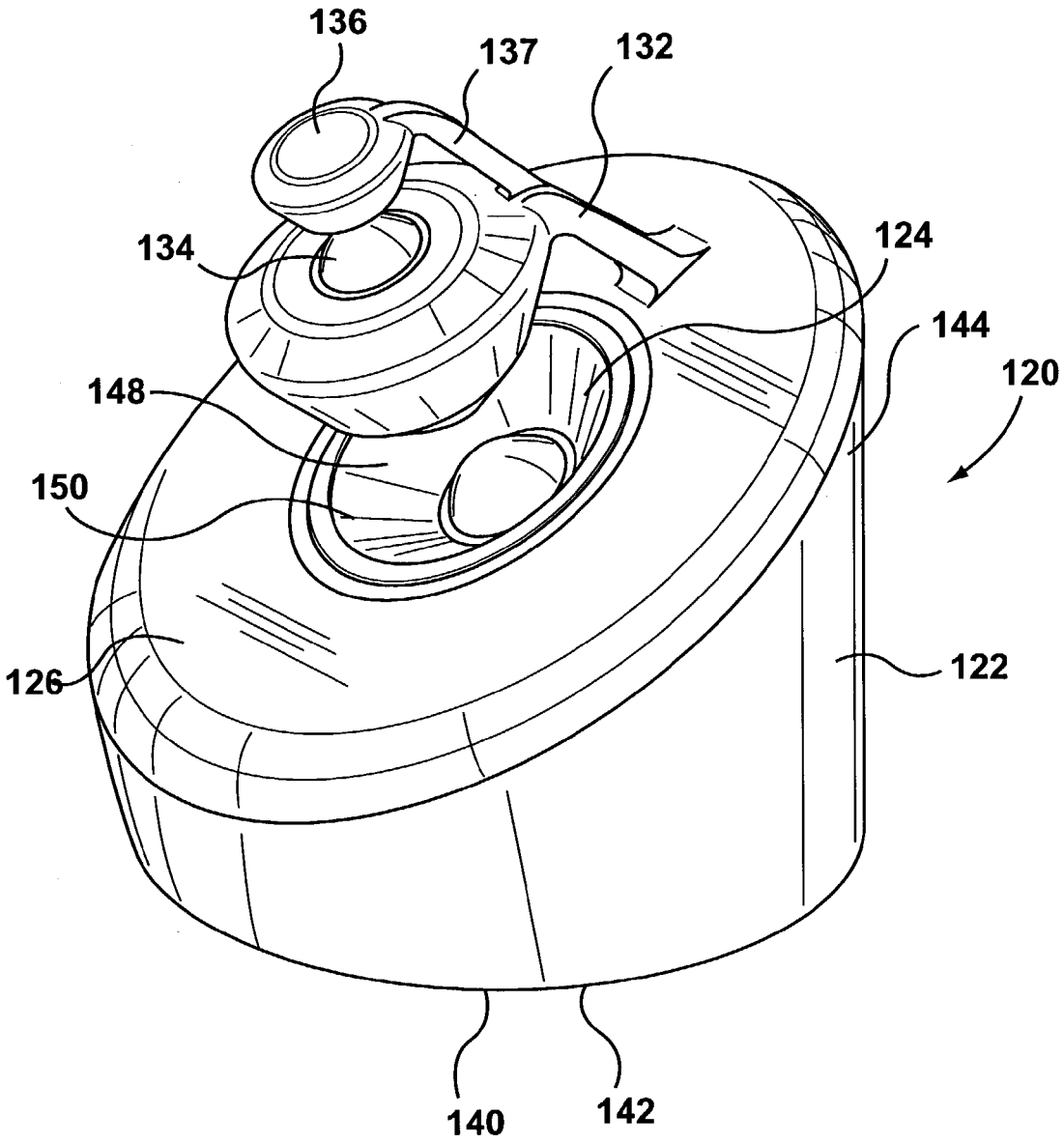
FIG. 5 is a perspective drawing of a loudspeaker according to a second embodiment of the present invention.
Figure 6:
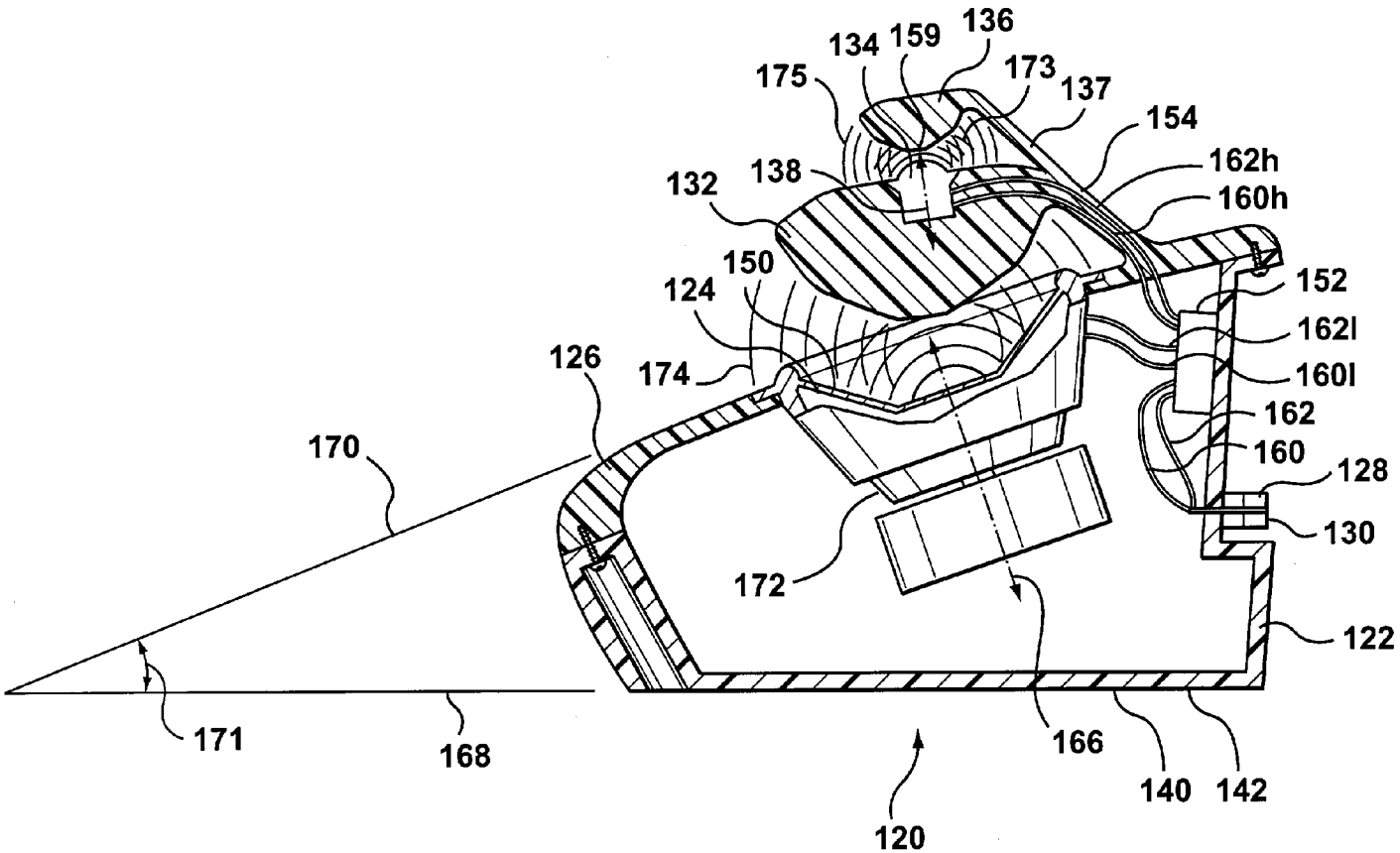
FIG. 6 is a cross-sectional side view of the loudspeaker of FIG. 5.

Reference is next made to FIGS. 5 and 6, which illustrate a loudspeaker 120 according to a second embodiment of the present invention. Components of loudspeaker 120 corresponding to components of loudspeaker 20 are identified with similar reference numerals increased by 100. Loudspeaker 120 has a housing 122, a driver 124, a housing baffle 126, input terminals 128, 130, a sound reflector 132, which are structured and operate in generally the same manner as the corresponding components of loudspeaker 20 (FIG. 1). In addition, loudspeaker 120 has a second driver 134, a second sound reflector 136 and a cross-over 152.

Driver 134 is mounted in the top side of sound reflector 132 and has an axis 138. Sound reflector 136 has a support 137 which extends from support 154 (or from the top of sound reflector 132). Sound reflector is positioned generally above driver 134.

Driver 134 is a high frequency driver, which is selected to produce sound waves at a higher frequency range than driver 124, typically with some overlap between the two frequency ranges. For example, in loudspeaker 120, driver 124 may be selected to produce sound between 50 Hz and 2 kHz and driver 134 may be selected to produce sound between 1 kHz and 18 kHz. (Typically the high end of the frequency range of driver 124 will be lower than that of driver 24 in loudspeaker 20, since loudspeaker 20 does not have a high frequency driver.) In another embodiment of the present invention, drivers 124 and 134 may be selected to have any suitable frequency range.

Cross-over 152 is mounted inside housing 122 and is coupled to terminals 128, 130 by wires 160, 162. Driver 124 coupled to cross-over 152 by wires 160*l*, 162*l*. Driver 134 is coupled to cross-over 152 by wires 160*h* and 162*h*. Cross-over 152 receives an audio signal from terminals 128, 130 and divides it into a low frequency audio signal and a high frequency audio signal in known manner. The low and high frequency audio signals have overlapping frequency ranges.

Driver 124 receives the low frequency audio signal from cross-over 152 and in response produces audio waves 172 in the same manner as driver 124 produces audio waves 72 (FIG. 4). Audio waves 172 are reflected by reflector 132 as sound waves 174.

Driver 134 receives the high frequency audio signal from cross-over 152 and in response produces audio waves 173. Reflector 136 is positioned such that at least some of audio waves 173 are incident on it. A reflecting surface 159 of reflector 136 reflects audio waves 173 outward from loudspeaker 120 as sound waves 175. A relatively large portion of sound waves 175 is directed from the front of loudspeaker 120. Progressively less of sounds waves 175 are in each direction at progressively larger angles from the front of loudspeaker 120.

The use of separate drivers 124 and 134 in loudspeaker 120 has several advantages over the single driver design of loudspeaker 20. First, the use of two drivers 124 and 134 allows drivers to be selected that provide a better sound quality within their selected frequency ranges. Second, the use of independent reflectors 132, 136 for the separate frequency ranges allows the sound field for each frequency range to be shaped more precisely, allowing the overall sound field of loudspeaker 120 to be shaped more closely to a desired shaping. The driver 134 is located further from the front of the loudspeaker 120 than the driver 124. Similarly, the reflector 136 is further from the front of the loudspeaker 120 than the reflector 132. As a result, the audio waves 172 from the driver 124 and reflector 132 have less distance to traverse to a listener than the audio waves 173 from the driver 134 and reflector 136. This is desirable as the audio waves 173 from the high frequency audio signal would otherwise reach a listener slightly before the audio waves 172 from the low frequency audio signal.

Figure 7:
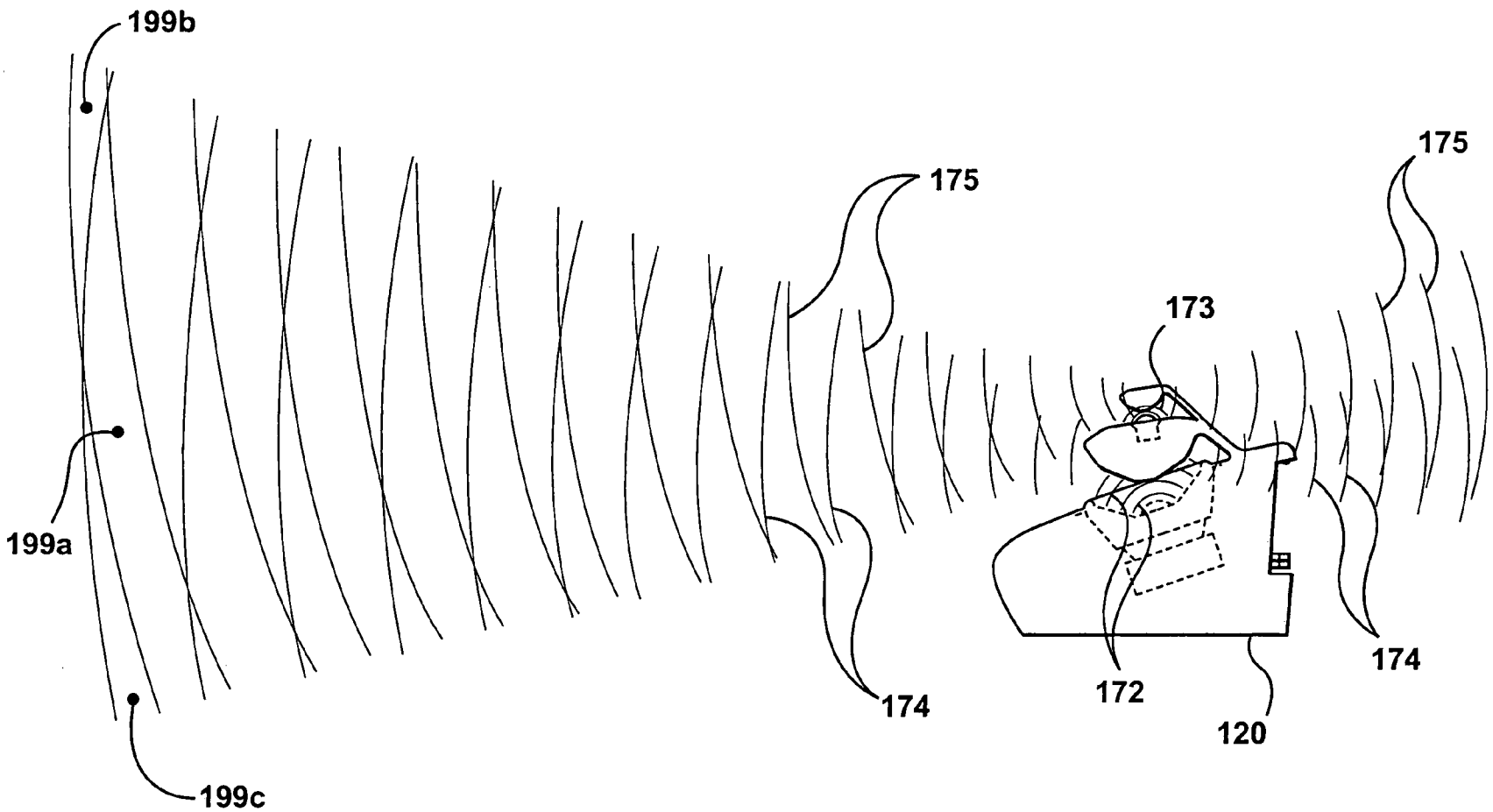
FIG. 7 is a side view of the loudspeaker of FIG. 5 illustrating a sound field.

Reference is next made to FIG. 7. Sound waves 174 and 175 are illustrated in cross-section propagating from the front and back of loudspeaker 120. Sound waves 174 and 175 collectively provide a sound field that covers the frequency ranges of both drivers 124 and 134. A listener situated at point 199*a* will hear the combined full sound field. Like loudspeaker 20, loudspeaker 120 produces a three-dimensional sound field. A listener situated at points 199*b* and 199*c* which are respectively above and below the height of speaker 120 will also hear the combined full sound field. A skilled person will be capable of selecting the angles of drivers 124 and 134 and their reflectors 132, 136 (labeled in FIGS. 5 and 6) to provide the combined sound field at the height required for any particular embodiment of the present invention.

Figure 8:
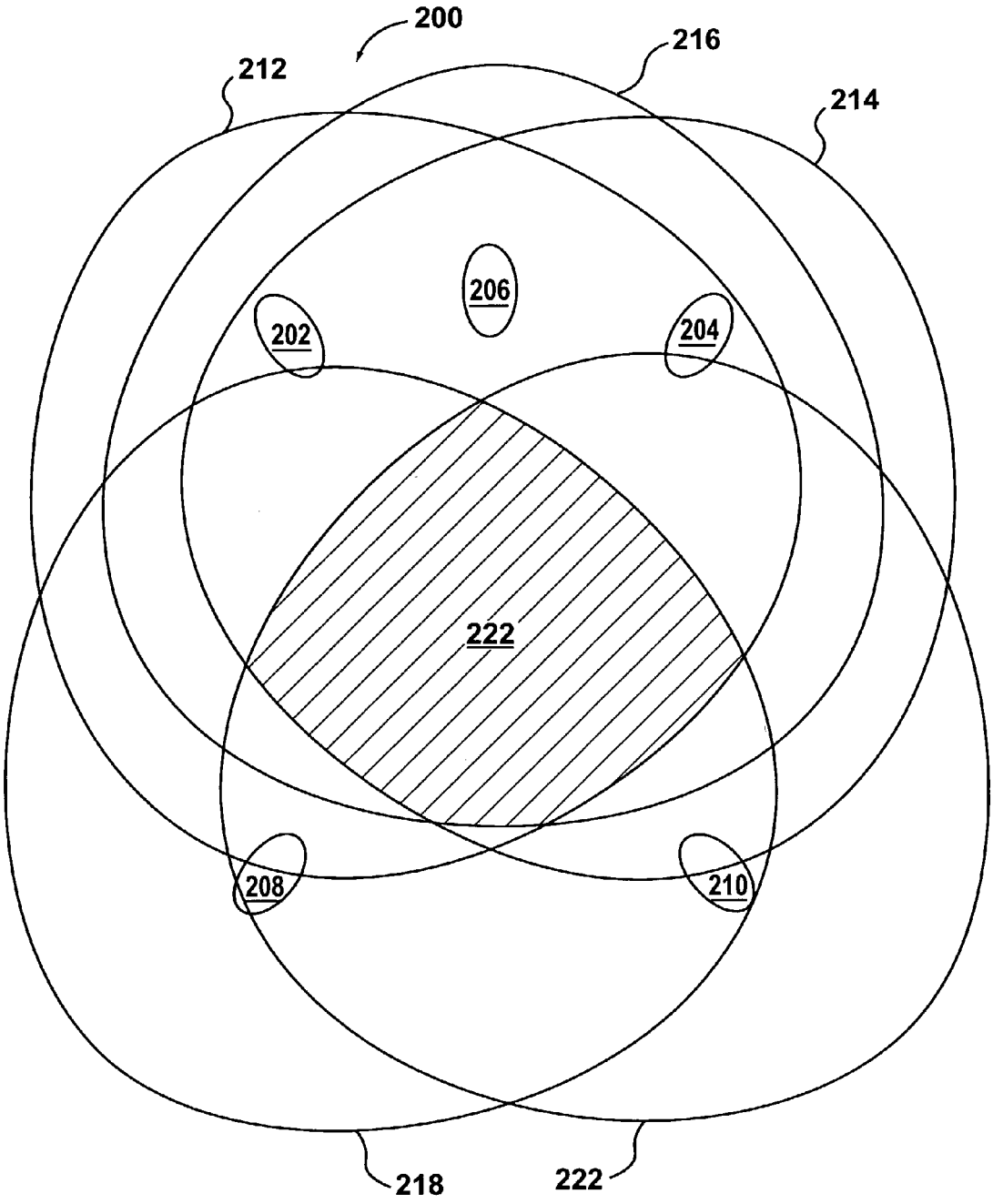
FIG. 8 illustrates the use of a multiple speakers according to the present invention.

Reference is next made to FIG. 8. Speakers 20 and 120 are suitable for use in multiple channel sound systems. Modern home theatre systems commonly include five or more speakers. A typical home theatre loudspeaker system 200 may include a front left loudspeaker 202, a front right loudspeaker 204, a center loudspeaker 206, a rear left loudspeaker 208 and rear right loudspeaker 210. The sound field of each of these speakers in the 2–5 kHz band is symbolically illustrated in FIG. 9 by curves 212 (front left loudspeaker 202), 214 (front right loudspeaker 204), 216 (center loudspeaker 206), 218 (rear left loudspeaker 208) and 220 (rear right loudspeaker 210). Each of these curves illustrate the region in which the associated loudspeaker may be effectively heard, in the shown layout. The five curves 212 to 220 overlap to provide a listening area 222. A listener situated in the listening area 222 will be able to hear all five speakers 202 to 210 and will enjoy a typical "surround sound" audio presentation from all five speakers, under the control of a sound signal source (not shown).

As mentioned earlier, low frequency sounds are relatively non-directional. In addition, a substantial amount of power is often required to generate such low frequency sounds. The five loudspeaker system of FIG. 8 may be combined in known manner with a low frequency loudspeaker or "subwoofer" in a "5.1" loudspeaker system that provides a sound field with a wide frequency range. For example, the low frequency loudspeaker may have a frequency range of 20 Hz to 80 Hz. The drivers 124 of speakers 202 to 210 may have a frequency range of 60 Hz to 2 kHz and the driver 134 of speakers 202 to 210 may have a frequency range of 1 kHz to 18 kHz. These frequency ranges are only exemplary and a skilled person will be capable of selecting drivers with frequency ranges that suit a particular application of the present invention.

Figure 9:
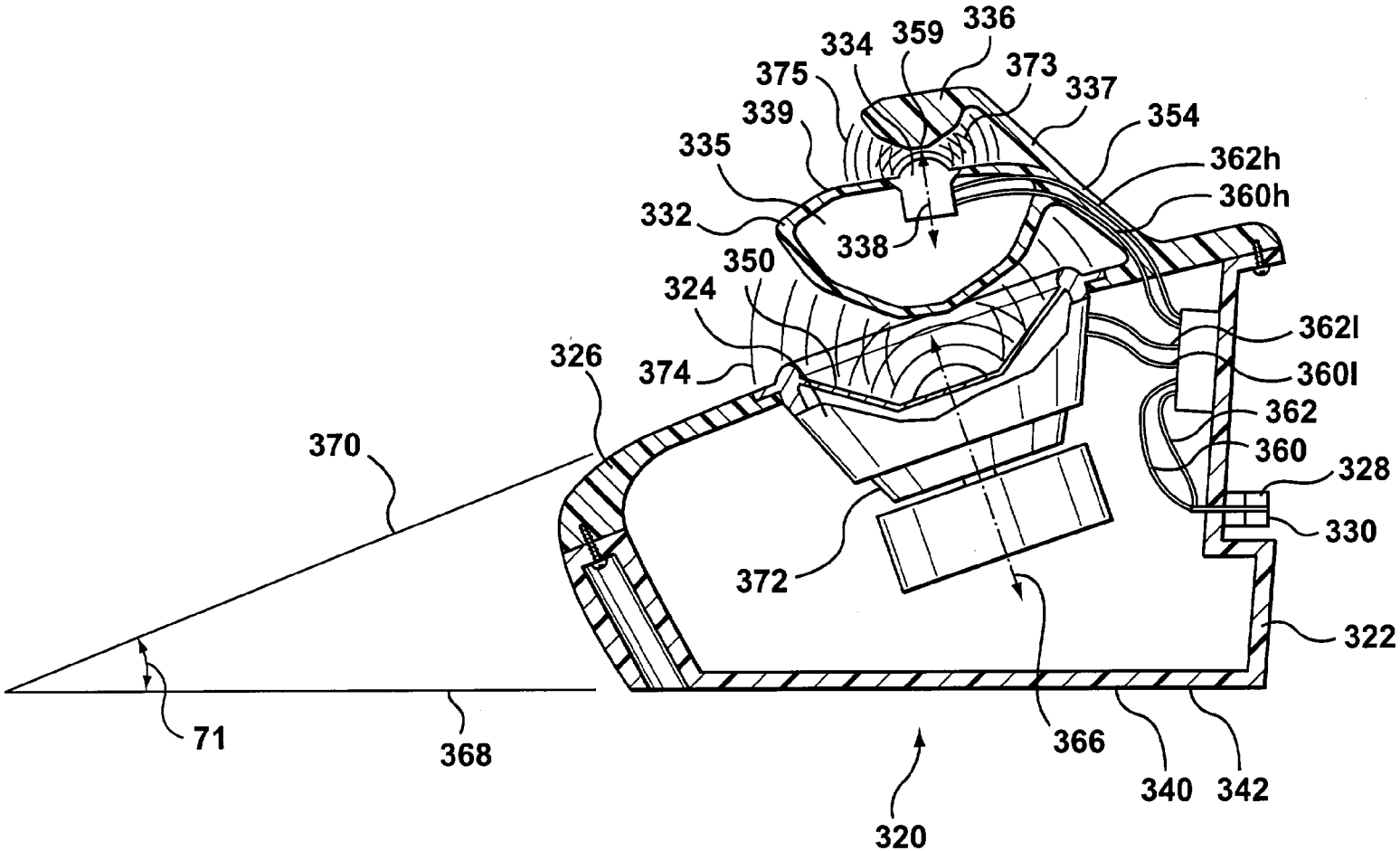
FIG. 9 is a cross-sectional side view of a loudspeaker according to a third embodiment of the present invention.

Reference is next made to FIG. 9, which illustrates a loudspeaker 320 according to a third embodiment of present invention. Loudspeaker 320 has a structure similar to loudspeaker 120 and corresponding components are identified by similar reference numerals increased by 200. High frequency driver 334 operates in a manner similar to high frequency driver 134. However, sound reflector 332 has been hollowed out to provide a sealed rear chamber 335 for high frequency driver 334. High frequency driver 334 has a hole 337 to release air pressure caused by movement of its cone 351. This volume of air contained within reflector 332 reduces the fundamental resonance of driver 334, thereby reducing distortion and improving power handling at the bottom of its frequency range and smoothing out its frequency response.

Figure 10:
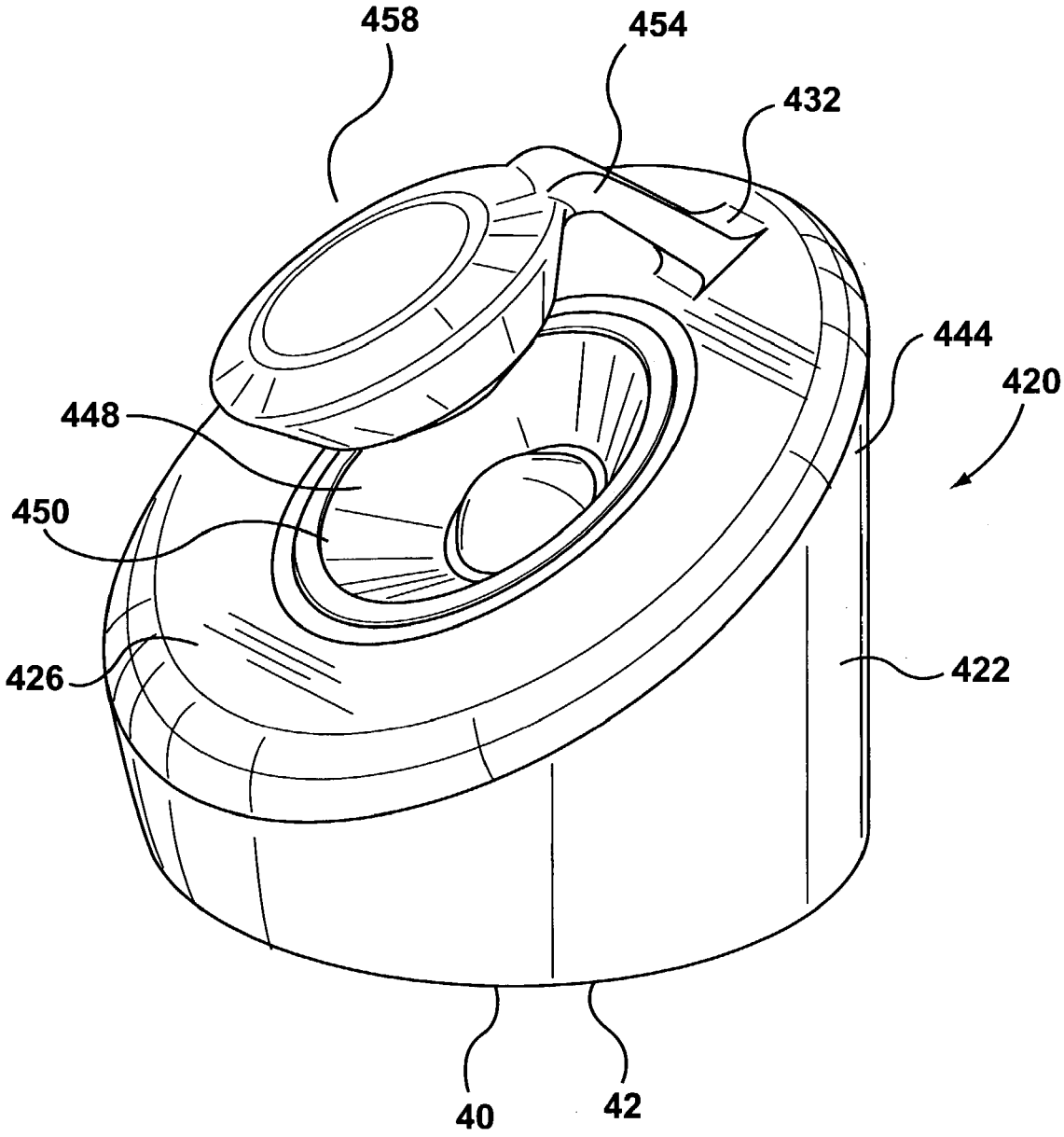
FIG. 10 is a perspective view of a loudspeaker according to a fourth embodiment of the present invention.

Reference is next made to FIG. 10, which shows a loudspeaker 420 according to a fourth embodiment of the present invention. The speakers described above all incorporate circular driver (i.e. drivers 24 and 134). The present invention may be used with a driver having an elliptical or other shape. Loudspeaker 420 is similar to loudspeaker 20. Corresponding components of loudspeaker 420 are identified by similar reference numerals increased by 400. Driver 424 has an elliptical shape and sound reflector 432 has a corresponding elliptical shape.

In other embodiments of the present invention, the driver (or drivers) may have any shape. For example, they may be conical, flat or dome shaped.

Loudspeakers 120 and 320 have two drivers and two corresponding reflectors. Other loudspeakers according to the present invention may have three or more drivers and corresponding reflectors. The three or more loudspeakers may have different and possibly overlapping frequency ranges. The drivers of such loudspeakers may be selected to provide a wider combined frequency response or a better quality sound reproduction or both.

Figure 11:
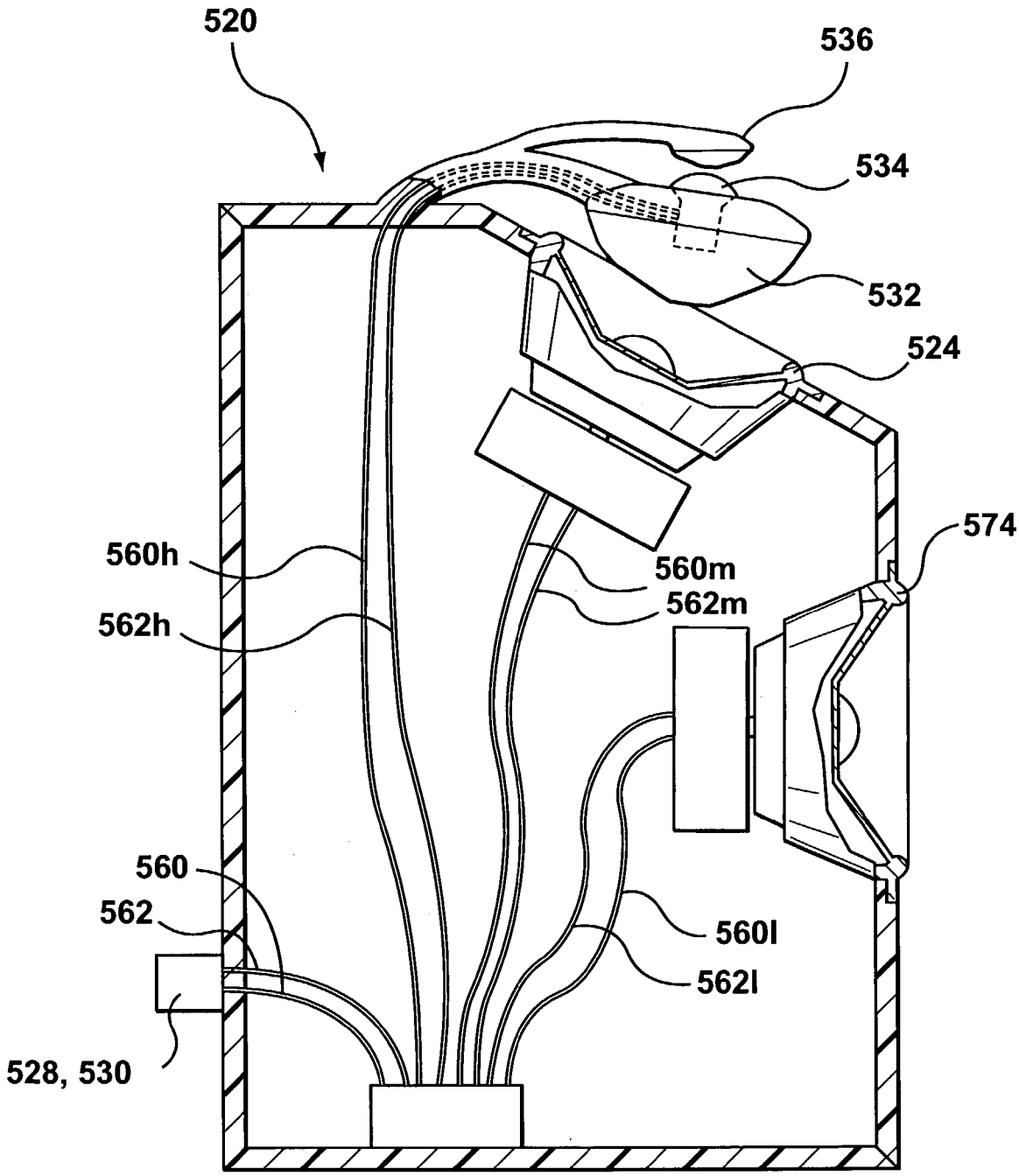
FIG. 11 is a cross-sectional side view of a loudspeaker according to a fifth embodiment of the present invention.

Reference is next made to FIG. 11, which illustrates a fifth embodiment of a loudspeaker 520 according to the present invention. Loudspeaker 520 has three drivers 524, 534 and 574. Driver 524 has a corresponding reflector 532 and driver 534 has a corresponding reflector 536. Drivers 524, 534 and reflectors 532, 536 operate in the same manner as drivers 124, 134 and reflectors 132, 136 of loudspeaker 120 (FIG. 6). Loudspeaker 520 has input terminals 528 and 530 which are coupled to a three way cross-over 552. Cross-over 552 divides an audio signal (not shown) received at terminal 528, 530 into low, mid-range and high frequency components. The high frequency components are provided to driver 534 through wires 560*h*, 562*h*. The mid-range frequency components are provided to driver 524 through wires 560*m*, 562*m*. The low frequency components are provided to driver 574 through wires 560*l*, 562*l*.

Driver 574 is selected to have a low frequency operational range and along with crossover 552 reproduces audio in response to the low frequency components of the audio signal. Since the low frequency audio output of driver 574 will be essentially omni-directional, driver 574 does not require a sound reflector.

Loudspeaker 520 is capable of producing sounds with a very wide frequency range, depending on the selection of drivers 524, 534 and 574, and with wide listening area.

Other variations and modifications of the invention are possible. For example, while the foregoing has referred to drives having cones, those of skill in the art will appreciate that diaphragms of other shapes may be substituted. All such modifications or variations are believed to be within the sphere and scope of he invention as defined by the claims appended hereto.

What is claimed is:

1. A loudspeaker comprising:

(a) a base defining a support plane, the base being operable to support the loudspeaker relative to a surface;

(b) a driver mounted to the base, the driver being movable parallel to an axis of movement through a center of the driver to produce sound waves; and (c) a reflecting surface mounted facing a diaphragm of the driver for reflecting sound waves from the driver, the reflecting surface being configured relative to the driver such that reflected sound energy is greatest in a selected direction from a front of the reflecting surface and the driver, and diminishes at progressively larger angles from the selected direction;

wherein the driver is aligned with a driver plane orthogonal to the axis of movement, the driver plane being a non-zero acute angle to the support plane; and the selected direction diverges from the driver plane.

2. The loudspeaker as defined in claim 1 wherein the reflecting surface is positioned relative to the driver such that the axis of movement of the driver intersects the reflecting surface.

3. The loudspeaker as defined in claim 2 wherein the axis of movement of the driver intersects the reflecting surface at a center thereof.

4. The loudspeaker as defined in claim 1 wherein a spacing of the reflecting surface from the driver varies around the driver and is largest at the front of the driver and the reflecting surface; and, an inclination of the reflecting surface relative to the driver plane varies around the driver and is largest at the front of the driver and the reflecting surface.

5. The loudspeaker as defined in claim 1 wherein the selected direction is substantially in a plane parallel to the axis of movement and orthogonal to the support plane.

6. The loudspeaker as defined in claim 3, wherein the non-zero acute angle is between 5 degrees and 85 degrees.

7. The loudspeaker as defined in claim 3, wherein the non-zero acute angle is between 10 degrees and 80 degrees.

8. The loudspeaker as defined in claim 3, wherein the non-zero acute angle is between 20 degrees and 35 degrees.

9. A loudspeaker system comprising (a) a base defining a support plane, the base being operable to support the loudspeaker relative to a surface;

(b) an input terminal for receiving an audio signal and a cross-over connected to the input terminal for dividing the audio signal into a plurality of component signals;

(c) a first driver mounted to the base and linked to the cross-over to receive a first component signal in the plurality of signals, the first driver being drivable by the first component signal to move parallel to a first axis of movement through a center of the first driver to produce sound waves;

(d) a first reflector mounted facing a first diaphragm of the first driver for reflecting sound waves from the first driver, the first reflector being configured relative to the first driver such that reflected sound energy is greatest in a first selected direction from a front of the first reflector and the first driver, and diminishes at progressively larger angles from the first selected direction; and, (e) at least one of a second driver for producing higher frequency sound waves than the sound waves produced by the first driver and a third driver for producing lower frequency sound waves than the sound waves produced by the first driver, the at least one of the second driver and the third driver being mounted to the base and linked to the cross-over to receive at least one component signal in the plurality of component signals from the cross-over;

wherein the first driver is aligned with a first driver plane orthogonal to the axis of movement, the first driver plane being at a non-zero acute angle to the support plane; and, the first selected direction diverges from the first driver plane.

10. The loudspeaker system as defined in claim 9 wherein the first reflector is positioned relative to the first driver such that the first axis of movement of the first driver intersects the first reflector.

11. The loudspeaker system as defined in claim 10 wherein the first reflector comprises a first reflecting surface facing the first driver; and, the first axis of movement of the first driver intersects the first reflecting surface at a center thereof.

12. The loudspeaker system as defined in claim 9 wherein the first reflector comprises a first reflecting surface facing the first driver;

a spacing of the first reflecting surface from the first driver varies around the first driver and is largest at the front of the first driver and the first reflector; and, an inclination of the first reflecting surface relative to the first driver plane varies around the first driver and is largest at the front of the first driver and the first reflector.

13. The loudspeaker system as defined in claim 11 wherein the at least one component signal comprises a low frequency signal; and, the third driver is linked to the cross-over to receive the low frequency signal, the third driver being drivable by the low frequency signal to produce the lower frequency sound waves.

14. The loudspeaker system as defined in claim 11 wherein the at least one component signal comprises a high frequency signal;

the second driver is linked to the cross-over to receive the high frequency signal, the second driver being drivable by the high frequency signal to move parallel to a second axis of movement through a center of the second driver to produce the higher frequency sound waves; and, the loudspeaker system further comprises a second reflector mounted facing a second diaphragm of the second driver for reflecting the higher frequency sound waves from the second driver, the second reflector being configured relative to the second driver such that reflected sound energy from the second reflector is greatest in a second selected direction from a front of the second reflector and the second driver, and diminishes at progressively larger angles from the second selected direction;

wherein the second driver is aligned with a second driver plane orthogonal to the second axis of movement, the second driver plane being at a second non-zero acute angle to the support plane; and the second selected direction diverges from the second driver plane.

15. The loudspeaker system as defined in claim 14 wherein the second non-zero acute angle is different from the first non-zero acute angle.

16. The loudspeaker system as defined in claim 14 wherein the second reflector is positioned relative to the second driver such that the second axis of movement of the second driver intersects the second reflector.

17. The loudspeaker system as defined in claim 16 wherein the second reflector comprises a second reflecting surface facing the second driver; and, the second axis of movement intersects the second reflecting surface at a center thereof.

18. The loudspeaker as defined in claim 14 wherein the second reflector comprises a second reflecting surface facing the driver;

a spacing of the second reflecting surface from the second driver varies around the second driver and is largest at the front of the second driver; and, an inclination of the second reflecting surface relative to the second driver plane varies around the second driver and is largest at the front of the second driver and the second reflector.

19. The loudspeaker system as defined in claim 14 wherein the second driver is mounted to the first reflector.

20. The loudspeaker as defined in claim 19 wherein the first reflector comprises a resonance chamber for the second driver.

21. The loudspeaker system as defined in claim 14 wherein the second selected direction is substantially parallel to the first selected direction.

22. The loudspeaker system as defined in claim 9 wherein the at least one component signal comprises a low frequency signal; and, the third driver is linked to the cross-over to receive the low frequency signal, the third driver being drivable by the low frequency signal to produce the lower frequency sound waves.

23. A method of directing sound waves from a driver of a loudspeaker, comprising:

(a) providing an audio signal to the driver, the driver being movable parallel to an axis of movement through a center of the driver to produce sound waves based on the audio signal;

(b) orienting the driver such that a driver plane orthogonal to the axis of movement is at a selected angle of inclination relative to a horizontal plane, the selected angle of inclination being a non-zero acute angle; and, (c) providing a reflecting surface facing the driver to reflect sound waves from the driver such that reflected sound energy is greatest in a selected direction from a front of the driver and diminishes at progressively larger angles from the selected direction, wherein the selected direction diverges from the driver plane.

* * * * *